US010303076B2

(12) United States Patent
Nedelin et al.

(10) Patent No.: US 10,303,076 B2
(45) Date of Patent: May 28, 2019

(54) ELECTROSTATIC PRINTING USING VARIANT DEVELOPER VOLTAGE

(71) Applicant: HP INDIGO B.V., Amstelveen, CO (US)

(72) Inventors: Peter Nedelin, Ashdod (IL); Mark Sandler, Rehovot (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/520,662

(22) PCT Filed: Dec. 12, 2014

(86) PCT No.: PCT/EP2014/077631

§ 371 (c)(1),
(2) Date: Apr. 20, 2017

(87) PCT Pub. No.: WO2016/091335

PCT Pub. Date: Jun. 16, 2016

(65) Prior Publication Data

US 2018/0231906 A1 Aug. 16, 2018

(51) Int. Cl.

| | |
|---|---|
| ***G03G 15/20*** | (2006.01) |
| ***G03G 15/01*** | (2006.01) |
| ***G03G 15/06*** | (2006.01) |

(52) U.S. Cl.

CPC ..... *G03G 15/0147* (2013.01); *G03G 15/065* (2013.01); *G03G 2215/0658* (2013.01)

(58) Field of Classification Search

USPC ..... 399/38, 53, 55, 310, 314

See application file for complete search history.

(56) References Cited

U.S. PATENT DOCUMENTS

| | | | |
|---|---|---|---|
| 6,625,415 | B2 | 9/2003 | Nakashima et al. |
| 7,400,850 | B2 | 7/2008 | Romem |

(Continued)

FOREIGN PATENT DOCUMENTS

| | | |
|---|---|---|
| JP | 2004058624 | 2/2004 |
| WO | WO-2014021869 | 2/2014 |

OTHER PUBLICATIONS

HP Indigo Digital Offset Color Technology, Mar. 2012. 16 pages, Retrieved from the Internet: http://www.crosstechinc.com/PDFs/US_Tech%20WP_LR.pdf.

*Primary Examiner* — Hoan H Tran
(74) *Attorney, Agent, or Firm* — HP Inc. Patent Department

(57) ABSTRACT

According to one example, there is provided an electrostatic printer. The printer includes a photoconductor member, an imaging unit to generate a latent electrostatic image on the photoconductor member, a developer unit including a colored toner, the developer unit to develop a colored toner image on the photoconductor member using an associated base developer voltage, and a controller. The controller is to obtain image data including color separation data representing a variant of the colored toner, to control the imaging unit to generate a latent electrostatic image on the photoconductor member in accordance with the obtained color separation data, to determine a variant developer voltage corresponding to the variant of the colored toner, and to control the developer unit to develop a toner image on the photoconductor member using the variant developer voltage to develop a toner image corresponding to the variant of the colored toner.

18 Claims, 6 Drawing Sheets

(56) References Cited

U.S. PATENT DOCUMENTS

| | | | | |
|---|---|---|---|---|
| 7,826,756 | B2 * | 11/2010 | Bae | G03G 15/065 399/49 |
| 7,869,726 | B2 * | 1/2011 | Sato | G03G 15/0808 399/44 |
| 8,792,796 | B2 | 7/2014 | Kella et al. | |
| 2009/0110422 | A1 | 4/2009 | Shinichi | |
| 2009/0231604 | A1 | 9/2009 | Miura | |
| 2009/0303556 | A1 | 12/2009 | Lieberman et al. | |

* cited by examiner

| COLOR OF COLOR SEPARATION | DEVELOPER VOLTAGE |
|---|---|
| CYAN | -465V |
| LIGHT CYAN | -233V |
| MAGENTA | -487V |
| LIGHT MAGENTA | -233V |
| YELLOW | -471V |
| BLACK | -480V |

FIGURE 4

| PROCESS COLOR | COLOR DENSITY | DEVELOPER VOLTAGE |
|---|---|---|
| CYAN | 100% | -465V |
| CYAN | 50% | -233V |
| MAGENTA | 100% | -487V |
| MAGENTA | 50% | -233V |
| YELLOW | 100% | -471V |
| BLACK | 100% | -480V |

FIGURE 5

| PROCESS COLOR | REQUIREMENT | DEVELOPER VOLTAGE |
|---|---|---|
| CYAN | 100% COLOR DENSITY | -465V |
| CYAN | 50% COLOR DENSITY | -233V |
| CYAN | 100% EXTRA OPAQUE | -664V |
| MAGENTA | 100% COLOR DENSITY | -487V |
| MAGENTA | 50% COLOR DENSITY | -233V |
| MAGENTA | 100% EXTRA OPAQUE | -661V |
| YELLOW | 100% COLOR DENSITY | -471V |
| YELLOW | 100% EXTRA OPAQUE | -659V |
| BLACK | 100% COLOR DENSITY | -480V |
| BLACK | 50% COLOR DENSITY | -231V |

FIGURE 6

ELECTROSTATIC PRINTING USING VARIANT DEVELOPER VOLTAGE

CROSS-REFERENCE TO RELATED APPLICATION

This application is a U.S. National Stage Application of and claims priority to International Patent Application No. PCT/EP2014/077631, filed on Dec. 12, 2014, and entitled "ELECTROSTATIC PRINTING."

BACKGROUND

Many electrostatic printing systems generate a latent electrostatic image on a photoconductor member and develop thereon a toner image that is transferred, either directly or indirectly, to a media. Toner may be transferred electrostatically to the photoconductor member from a developer unit.

Some electrostatic printing systems may use a dry toner powder, whereas other printing systems, such as liquid electro-photographic (LEP) printing systems may use a liquid toner.

BRIEF DESCRIPTION

Examples will now be described, by way of non-limiting example only, with reference to the accompanying drawings, in which:

FIG. 4 is an example lookup table according to one example;

FIG. 5 is an example lookup table according to one example;

FIG. 6 is an example lookup table according to one example; and

DETAILED DESCRIPTION

Figure 1:
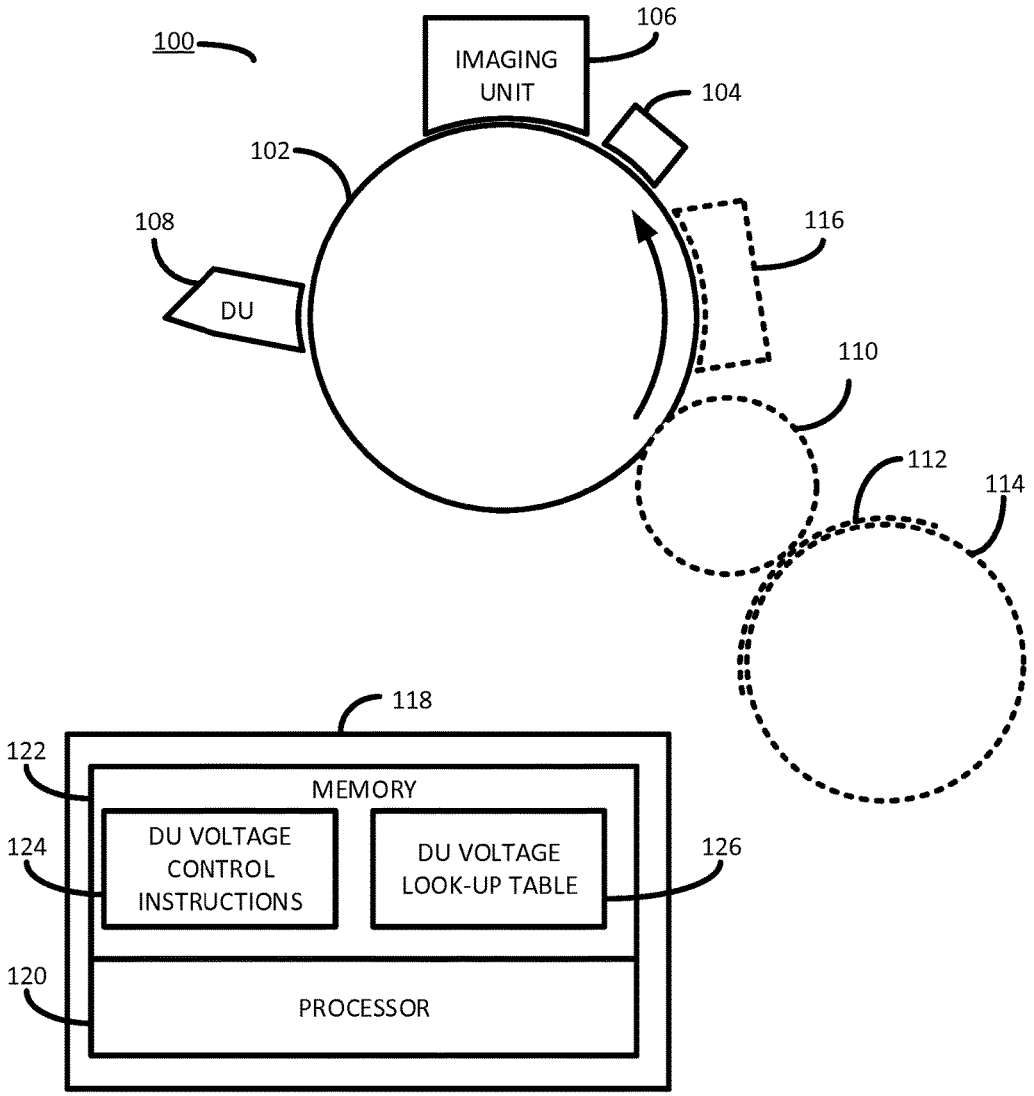
FIG. 1 is a block diagram of a printing system according to one example.

The examples and description below make reference generally to liquid electro-photographic (LEP) printing systems. Such printing systems electrostatically transfer liquid toner to a photoconductor member for onward transfer to a media. However, the techniques described herein may also apply, with appropriate modifications, to other electrostatic printing systems, such as dry toner printing systems.

Digital images to be printed are generally generated in an additive color space, such as an RGB (red, green, blue) color space. Digital images may have substantial color depth, meaning that each image pixels may represent any of a large number of colors. For example, in digital image having 32 bit color depth each image pixel may represent one of over 16 million colors.

Printers, on the other hand, operate in a subtractive color space, such as a CMYK (cyan, magenta, yellow, black) color space. Furthermore, printers generally have a very low color depth. For example, most printers are able to either print a dot of color at particular location on a media or not to print a dot of color at that location.

Before a digital image can be printed the image has to be converted into the color space of the printer that is going to print the image.

A typical color LEP printer may be provided in a four process color (CMYK) configuration, allowing printed marks of cyan (C), magenta (M), yellow (Y), and black (K) to be selectively made.

Accordingly, an image to be printed on a CMYK printer is processed to generate separate images, each representing a single one of the C, M, Y, and K color channels. These images are referred to as color separations. Techniques for converting an image from one color space to another are widely known.

To generate grey scales, or shades, halftoning techniques may be used. Halftoning enables continuous tones to be represented in a printed image. Halftoning techniques may vary the space between printed marks (frequency modulation halftoning), and/or the size of printed marks (amplitude modulation halftoning) to enable a large range of continuous tones to be represented. However, lights tones are represented by using a low density of printed marks, which can lead to individual printed marks becoming visible and being perceived as grainy. This may often be the case with some photographic images. Printed images exhibiting graininess may be perceived as being low quality. Each color separation may use a different halftone screen, for example at a unique halftone screen angle.

To reduce graininess in printed images additional light colored toners, such as light cyan (c), and light magenta (m), may be included in a six color toner (CcMmYK) configuration. In some examples light black toner may also be used. Light colored toners may typically have a color density of about 30% to 70% that of a standard colored toner. Use of light colors enables light tones to be represented using a higher density of light-colored printed marks than is possible when using base (i.e. non-light) colors. This has the effect of reducing perceived graininess, and may hence improve the perceived quality of a printed image.

In other configurations additional spot color toners may be included, such as orange, and green, or other colors such as specific Pantone™ colors. In other configurations non-colored toners may also be included, such as transparent toner. Herein, however, use of the term 'colored toners' may encompass non-colored toners.

LEP printing systems comprise at least one developer unit to transfer, or develop, liquid toner from the developer unit to a photoconductor member on which a latent electrostatic image has been generated. In a CMYK configuration, an LEP printer may comprise four developer units, one for each of C, M, Y, and K colored toners. The photoconductor member may be referred to as a photo imaging plate (PIP), although it may be in the form of a drum or belt.

A developer unit is configured to generate toner images at 100% color density, such that a printed toner image accurately represents an intended color. For example, a black developer unit is configured to generate black images having 100% color density, a cyan developer unit is configured to generate cyan images having 100% color density, and so on.

In LEP printing systems, the thickness of a toner image has to be precisely controlled, since even small variations in this thickness may affect its optical density, and hence may adversely affect color accuracy of a printed image. Since the thickness of a toner image generated by a developer unit is based on the electrical potential between the developer unit and the charged portions of the PIP, color accuracy may be ensured by carefully choosing the developer voltage.

Each developer unit has an associated target developer voltage which may, in some examples, be in the range of about −450 to −500V. In other examples, however, the developer voltage may be in a different range. To ensure color accuracy, a precise base developer voltage within the target developer voltage range may be determined for each developer unit following a suitable color calibration operation. For example, a color calibration operation may consist of printing multiple color patches using various developer voltages within the target developer range. The printed color patch that best represents the intended color is determined, for example either manually or using a spectrophotometer, and the corresponding developer voltage that was used to print the chosen color patch is selected as the base developer voltage and is used in all subsequent printing operations by that developer unit. Each developer unit may have a different base developer voltage. Such a color calibration may be performed periodically by a printing system.

Examples described herein provide a printing system that is able to print toner images of colors not present in the printing system. For example, examples described herein enable a CMYK printing system to operate as a CcMmYK printing system, without the presence of light cyan or light magenta toners.

Furthermore, as described further below, examples described herein provide a printing system that is able to generate toner images at varying levels of color density, from a single developer unit. For example, examples described herein may provide a printing system to generate toner images at one or more of 25%, 50%, 75%, and 100% color density. In other examples a printing system may be provided to generate toner images at any suitable color density less than 100%.

Other examples described herein may provide a printing system to generate thicker toner images than toner images calibrated to provide 100% color density. This may allow the generation of toner images having increased opacity.

Referring now to FIG. 1 there is shown a simplified illustration of a liquid electro-photographic (LEP) printing system 100 according to one example. The printing system 100 comprises a photoconductor member 102. In the example shown the photoconductor member 102 is in the form of a drum, although in other examples the photoconductor member 102 may have a different form, such as a continuous belt or any other suitable form. In operation the photoconductor member 102 rotates in the direction shown by the arrow.

A charging unit 104 is provided to generate a substantially uniform electrical charge on surface of the photoconductor member. In one example the generated electrical charge may be in the range of about 800 to 1100 V.

An imaging unit 106 is provided to selectively dissipate electrical charge on the photoconductor member 102 by selectively emitting light onto the surface of the photoconductor member 102. In one example the imaging unit 106 includes at least one laser. The imaging unit selectively dissipates charge in accordance with an image to be printed, or more precisely, in accordance with an image that represents a single color separation, or single color channel, of the image to be printed.

The imaging unit thus creates a latent electrostatic image on the surface of the photoconductor member 102 that comprises charged areas and non-charged areas that correspond to portions of the image that are to receive toner, and portions of the image that are not to receive toner.

A developer unit 108 is provided to electrostatically transfer liquid toner stored within the developer unit 108 to the surface of the photoconductor member 102 in accordance with the latent image thereon. The liquid toner may comprise charge directors. Once an image has been developed on the photoconductor member 102 the image may be electrostatically transferred to an intermediate transfer member 110 for onward transfer, under pressure from an impression roller 114, to a media 112. In other examples the image developed on the photoconductor member 102 may be transferred directly to a media without the use of an intermediate transfer member 110.

In some examples a cleaning unit 116 may be provided to remove any traces of toner remaining on the surface of the photoconductor member 102 after transfer of the image to the intermediate transfer member 110 or after direct transfer to a media, as well as to dissipate any residual electrical charges on the surface of the photoconductor member 102.

It should be noted that, depending on the size of the photoconductor member 102 and the size of the image to be printed a latent image corresponding to just a portion of the image to be printed may be present on the photoconductor member 102 at any one time.

Figure 2:
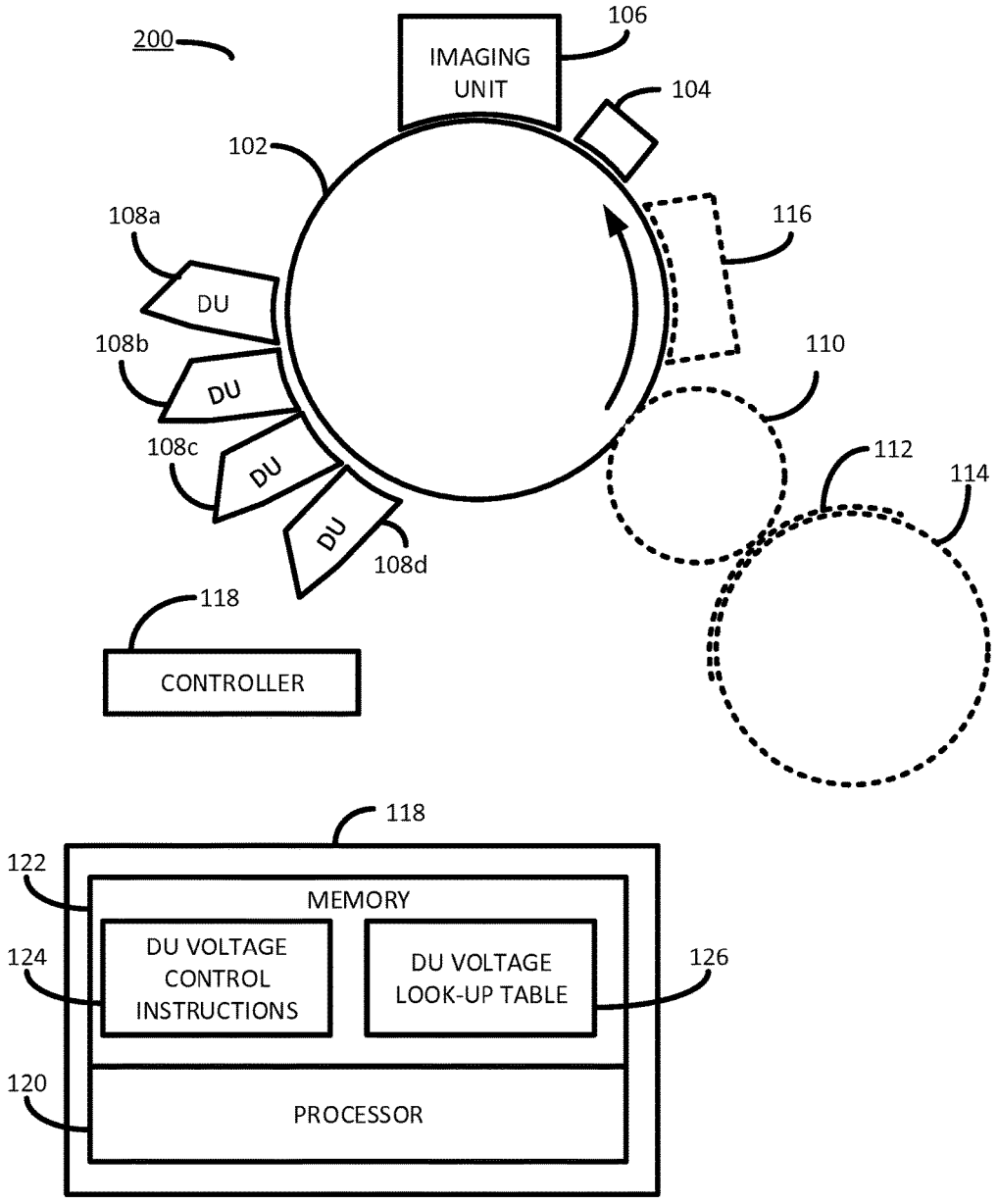
FIG. 2 is a block diagram of a printing system according to one example.

In the example shown in FIG. 1 a single developer unit 108 is provided. In other examples, such as that shown in FIG. 2, a printing system 200 may comprise multiple developer units, for example one for each of the colored toners the printing system is configured to operate with.

Each developer unit may be retractably engageable, such that each developer unit may engage with the photoconductor member 102 to apply toner to the photoconductor member 102 when a latent image of a corresponding color separation is generated on the photoconductor member 102. For example, when a latent image of a cyan color separation is generated on the photoconductor member 102, a developer unit containing cyan toner is engaged with the photoconductor member 102, whilst any other developer units are in a retracted position.

Where multiple developer units are present in the printing system 100 the printing system may operate in a so-called multi-shot mode.

In a multi-shot mode, the printing system obtains images representing different color separations of an image to be printed. The printing system then generates a single latent image representing one of those color separations on the PIP 102 and develops an image on the PIP 102 using a corresponding developer unit. The developed image is then transferred, either directly or indirectly, to a media. The process is then repeated for a different color separation using a different developer unit, until each of the appropriate color separations have been transferred to a media.

In one example, where multiple developer units are present in the printing system 100 the printing system may operate in a co-called one-shot mode.

In a one-shot mode, the printing system obtains images representing different color separations. The printing system then generates a single latent image represent one of those color separations on the PIP 102 and develops an image on the PIP using a corresponding developer unit. The developed image is then transferred to an intermediate transfer member 110. The process may then be repeated for a different color separation using a different developer unit, until each of the appropriate color separations have been transferred to the intermediate transfer member 110. All of the generated images may then be transferred to a media 112 on the impression roller 114 in a single transfer.

The operation of the printing system is generally controlled by a printer controller 118. The printer controller 118 comprises a processer 120, such as microprocessor, coupled to a memory 122 through an appropriate communications bus (not shown). The memory 122 stores developer unit voltage control machine readable instructions 124. The memory 122 additionally stores a developer unit voltage look-up table 126, where data relating to developer voltages to be used with different ones of the developer units may be stored. The controller 118 may execute the instructions 124 to cause the printer controller 118 to operate a printing system as described herein.

As previously mentioned, the electrical potential between a developer unit and charged portions of the PIP 102 has a direct relationship to the thickness of a layer of toner developed on the PIP. Accordingly, as previously mentioned, even small variations in this thickness may affect the optical density of a developed image, and hence may adversely affect color accuracy.

Overview

Examples described herein are based on the realization that a developer unit may be selectively operated with a developer voltage that is different from a base developer voltage. For example, operating a developer unit at a base developer voltage enables the developer unit to develop toner images having a thickness that results in the toner image having 100% color density. Furthermore, operating a developer unit at a variant developer voltage that is different to the base developer voltage enables the developer unit to develop toner images that have a different thickness. If the variant developer voltage causes a developer unit to develop a toner image that is thinner than that developed when using the base developer voltage the resulting color density of the developed toner image may be less than 100%. For example, a variant developer voltage may be chosen such that developed toner images have the same color density as a corresponding light colored toner. For example, a variant developer voltage may be chosen such that developed toner images have a color density that is 25%, 50%, 75%, or any suitable intermediate color density.

It should be noted, however, that with some printing systems it may not be possible to achieve a range of different color densities by using a variant developer voltage. For example, in some printing systems it may be practical to operate a single variant developer voltage to achieve a single lighter color density in the range of about 45 to 75%. In other printing system, however, it may be possible to operate multiple variant developer voltages to achieve multiple lighter color densities. In one example a variant developer voltage may be about 200V higher or lower than a base developer voltage, although in other examples the variant developer voltage may be higher or lower. For example, in one example a variant developer voltage may be in the range of about −250 to −300 V.

Accordingly, this enables a single developer unit to develop toner images at multiple color densities. This allows, for example, a cyan developer unit to develop cyan colored toner images and light cyan colored toner images.

In one example, the techniques described herein enable a 4 color CMYK printing system to operate as a 6 color CcMmYK printing system.

If the variant developer voltage causes a developer unit to develop a toner image that is thicker than that developed when using the base developer voltage the developed toner image may have increased opacity. This may be particularly useful when using light colored toners, such as white or yellow toner, for example when printing on non-white media.

For ease of explanation, the term 'base color' is used herein to refer to a color of toner at 100% color density that is available in a printing system. For example, in a printing system having cyan, magenta, yellow, and black colored toners, these colors are referred to a 'base colors'. The term 'variant color' is used herein to refer to a base color at less than 100% color density.

Example Operation

Figure 3:
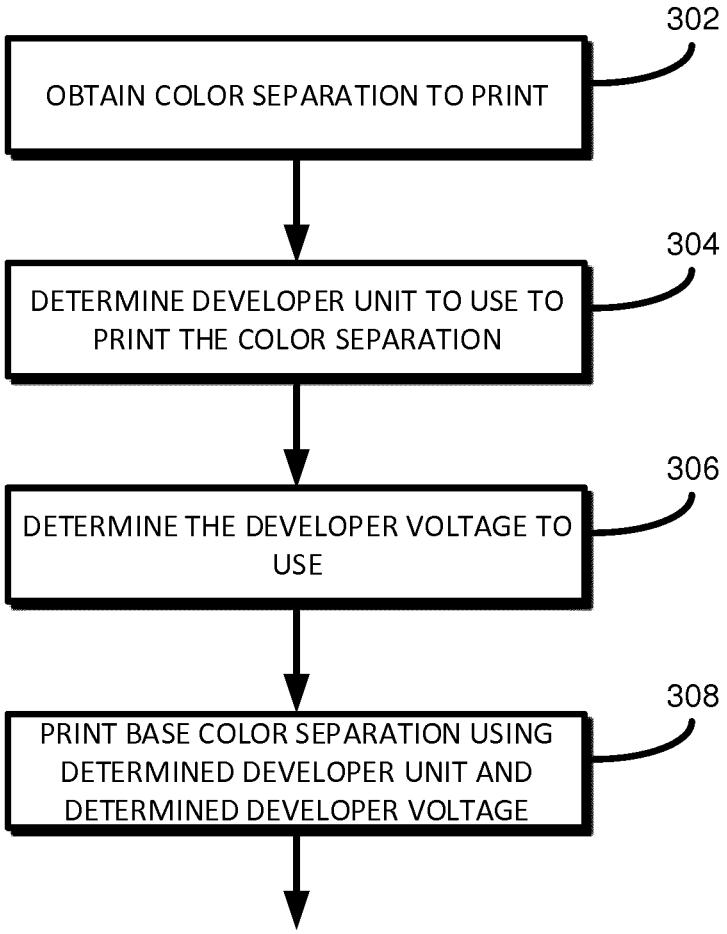
FIG. 3 is a flow diagram outlining a method of operating a printing system according to one example.

Example operation of the printing system will now be described, by way of example only, with reference to the flow diagram of FIG. 3.

At 302, the printer controller 118 obtains a color separation to print. In one example the color separation may be obtained from a raster image processor (RIP) external to the printing system. In another example the color separation may be generated by the printing system by processing an obtained image to be printed. In one example the obtained color separation may be one of a set of color separations generated from an image to be printed. Each color separation is associated with a colored toner with which the color separation is to be printed.

In the present example, six color separations are obtained corresponding to each of: cyan (C), light cyan (c), magenta (M), light magenta (m), and black (K) colors. In other examples a greater or lesser number of color separations may be obtained. In the present example, since the printing system has cyan, magenta, yellow, and black toners available, these colors are referred to as the base colors, whilst the light cyan and light magenta colors, for which no toners are present in the printing system, are referred to a variant colors.

Each color separation is represented as a monochrome raster image. Each color separation may represent halftone data. Each color separation may have data associated therewith identifying which color toner is to be used to print it. In one example the data may identify a color, such as 'cyan', 'light-cyan', etc. In another example the data may identify a base color and an associated color density, such as 'cyan 100%', 'cyan 50%', etc. In another example each color separation may be identified by the order in which it is obtained, for example if a set of color separations are obtained.

At 304, the printer controller 118 determines which one of the developer units in the printing system is to be used to print an obtained color separation. However, since the printing system in the current example comprises only CYM and K toners, any color separation that is identified as being 'cyan' (whether 'cyan', 'light cyan', '50% cyan', etc.) will be printed by the cyan develop unit, and so on for the other color separations.

At 306, the printer controller 118 determines the developer voltage to use with the determined developer unit for each color separation. In one example, the printer controller determines the developer voltages through use of the developer unit voltage lookup table 126.

An example of a developer unit voltage lookup table is shown in FIG. 4. For each of the colors cyan, light cyan, magenta, light magenta, yellow, and black, is stored a corresponding developer unit voltage that is to be used, with the appropriate developer unit, when generating toner images for each of the color separations. The controller 118 may thus determine the appropriate developer voltage to use for each color separation. It should be noted that the voltages in the example lookup tables are given by way of example only. For example, the voltages may differ depending on numerous factors that may include: the type of printing system used; the type of toners used; and the charge on the photoconductor imaging plate.

A further example of a developer unit voltage lookup table is shown in FIG. 5. In this example, for each of the colors a set of different color densities are given, each with a corresponding developer voltage. For example, to print a cyan color separation at 100% color density a developer voltage of −465V is to be used, to print a cyan color separation at 50% color density a developer voltage of −233V is to be used. The controller 118 may thus determine the appropriate developer voltage to use for each color separation.

In one example, the controller 118 may interpolate data stored in the lookup table 126 to determine a developer voltage for any color density that is not specifically stored in the lookup table 126.

A further example of a developer unit voltage lookup table is shown in FIG. 6. In this example additional developer unit voltages are provided for printing toner images that are to have enhanced opacity. As previously mentioned, this may be achieved by selecting a developer voltage higher than a base developer voltage used to generate a 100% color density toner image.

The developer voltages within the lookup table 126 may be determined during a periodic calibration procedure, as previously discussed. The number of entries in the lookup table 126 may be varied to contain a greater or lesser number of entries, depending on particular circumstances. For example, a smaller lookup table may allow a smaller number of color calibration patches to be printed.

In other examples, the controller 118 may not include a developer voltage lookup table, but may determine a variant developer voltage mathematically, for example from a mathematical model defining the relationship between developer voltage and corresponding color density.

At 308 the controller 118 controls the printing system to print each of the obtained color separations using the determined developer unit voltages.

Figure 7:
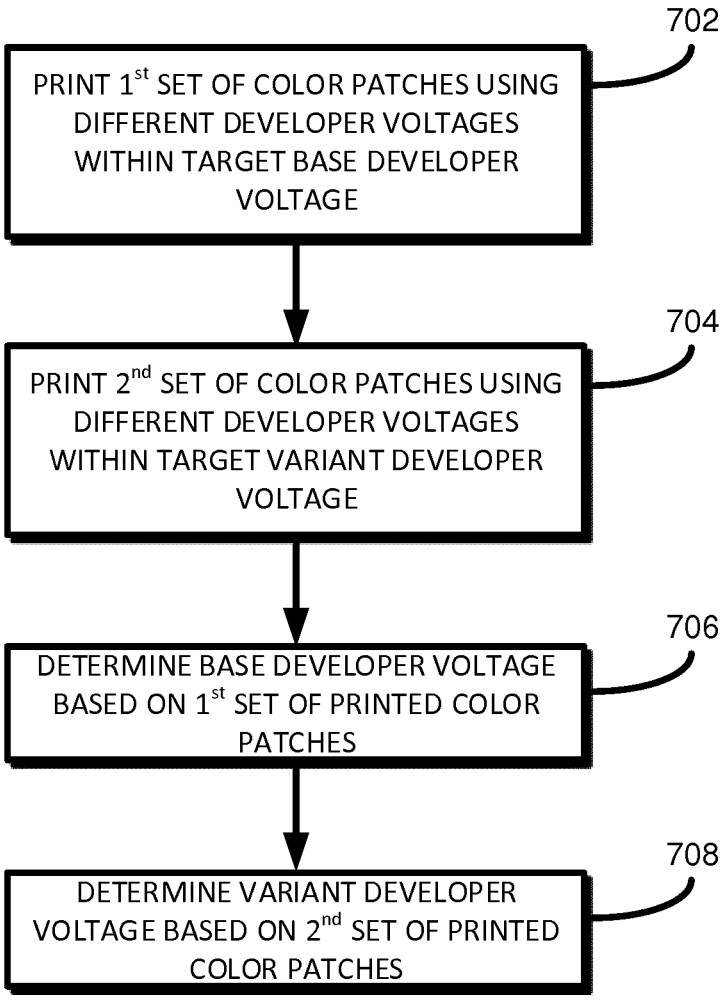
FIG. 7 is a flow diagram outline a method of calibrating a printing system according to one example.

Referring now to FIG. 7, there is shown a flow diagram outlining an example method of determining base and variant developer voltages according to one example.

At 702, the printer controller 118 causes the printing system 100 to print, using a selected developer unit, a first set of color patches using different developer voltages within the target base developer voltage range. In one example 16 color patches are printed, each with a different developer voltage, although in other examples a greater or smaller number of color patches may be printed.

At 704, the printer controller 118 causes the printing system 100 to print, using the selected developer unit, a second set of color patches using different developer voltages around a variant developer voltage, or within a target variant developer voltage range. In one example 16 color patches are printed, each with a different developer voltage, although in other examples a greater or smaller number of color patches may be printed.

At 706, a color patch that best matches the base color of the selected developer unit is selected. In one example this may be selected automatically in response to colorimetric metric measurements of each color patch having been obtained, for example from a spectrophotometer (not shown). In another example the color patch may be selected manually, for example, by a printing system user. The processor 118 then stores the developer voltage used to print the selected color patch as the base developer voltage for a developer unit that was used to print the color patches.

At 708, a color patch that best matches the desired variant base color is selected. In one example this may be selected automatically in response to colorimetric metric measurements of each color patch having been obtained, for example from a spectrophotometer (not shown). In another example the color patch may be selected manually, for example, by a printing system user. The processor 118 then stores the developer voltage used to print the selected variant color patch as the variant developer voltage for the selected developer unit.

Although the techniques discussed above relate to so-called process colors, the techniques may also be used for use with spot colors. For example, the lookup table 126 may additionally include a developer voltage to be used with a spot color developer unit to print a spot color color separation at 100% color density. Additionally, the lookup table 126 may additionally include a developer voltage to be used with a spot color developer unit to print a spot color color separation at any other suitable color density, such as 25%, 50%, 75% or any suitable intermediate color density. As with the process colors, use of a variant developer voltage is dependent on a corresponding color separation being obtained.

As discussed earlier, using additional light colors may be used to help reduce perceived graininess of a printed image. However, graininess may be further reduced when using light colors by using a larger spot size. By spot size is meant the size of the smallest spot of toner that is printable. In a LEP printing system, where the writing unit comprises a laser, spot size may be increased by increasing the electrical power supplied to the laser, which causes an increase in the diameter of the spot generated by the laser on the PIP.

In one example, in a HP Indigo 7000 digital press the spot size was increased from about 35 mm to about 75 mm. This was achieved by increasing the writing head power from about 0.8 $\mu J/cm^2$ to about 2.4 $\mu J/cm^2$.

If using a larger spot size and lighter colored toner, the halftoning techniques used to generate the corresponding color separation will need to take into account the larger spot size.

It should be noted that the term 'image' used herein is intended to include any suitable printable content.

It will be appreciated that examples described herein can be realized in the form of hardware, software or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples described herein.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention claimed is:

1. An electrostatic printer comprising:

a photoconductor member;

an imaging unit to generate a latent electrostatic image on the photoconductor member;

a developer unit comprising a colored toner, the developer unit to develop a base color toner image on the photoconductor member corresponding to the latent electrostatic image using a base developer voltage; and a controller to:

obtain image data comprising color separation data representing a variant of the colored toner;

control the imaging unit to generate a variant color latent electrostatic image on the photoconductor member in accordance with the variant color color separation data;

determine a variant developer voltage corresponding to the variant of the colored toner; and control the developer unit to develop a variant color toner image on the photoconductor member corresponding to the variant color latent electrostatic image using the variant developer voltage, wherein the controller controls the imaging unit to generate the variant color latent electrostatic image on the photoconductor member in accordance with the variant color color separation data using a larger spot size than when generating a base color latent electrostatic image on the photoconductor member in accordance with base color color separation data.

2. The printer of claim 1, wherein the variant developer voltage is different to the base developer voltage.

3. The printer of claim 1, wherein the variant of the colored toner has a color density different to the colored toner.

4. The printer of claim 1, wherein the variant developer voltage causes the developer unit to develop the variant color toner image thinner than the base color toner image developed using the base developer voltage.

5. The printer of claim 1, wherein the variant developer voltage causes the developer unit to develop the variant color toner image thicker than the base color toner image developed using the base developer voltage.

6. The printer of claim 1, wherein the controller determines the base developer voltage and the variant developer voltage for the developer unit by performing a color calibration process.

7. The printer of claim 1, wherein the developer unit comprises a cyan developer unit and wherein the controller is to obtain image data representing a cyan color separation and a light cyan color separation and to control the printer to develop the cyan color separation with the cyan developer unit using the base developer voltage, and to control the printer to develop the light cyan color separation with the cyan developer unit using the variant developer voltage.

8. The printer of claim 1, wherein the developer unit comprises a magenta developer unit and wherein the controller is to obtain image data representing a magenta color separation and a light magenta color separation, and to control the printer to develop the magenta color separation with the magenta developer unit using the base developer voltage, and to control the printer to develop the light magenta color separation with the magenta developer unit using the variant developer voltage.

9. The printer of claim 1, wherein the printer is a liquid electro-photographic (LEP) printer and wherein the colored toner is a liquid toner.

10. The printer of claim 1, wherein the base developer voltage is in the region of about −450 to −500V and wherein the variant developer voltage is in the region of about −250 to −300V.

11. A method of operating an electrostatic printing system comprising a developer unit to develop a toner image on a photoconductor member in accordance with a latent electrostatic image on the photoconductor member, the method comprising:

obtaining a first color separation representing a colored toner and a second color separation representing a variant of the colored toner;

generating on the photoconductor member a latent electrostatic image corresponding to the first color separation;

developing, with the developer unit using a base developer voltage, a base color toner image on the photoconductor member in accordance with the latent electrostatic image corresponding to the first color separation;

generating on the photoconductor member a latent electrostatic image corresponding to the second color separation; and developing, with the developer unit using a variant developer voltage, a variant color toner image on the photoconductor member in accordance with the latent electrostatic image corresponding to the second color separation, wherein the developer unit comprises a color developer unit for a color, wherein obtaining the first color separation and the second color separation comprises obtaining a color separation for the color and a light color separation for a light color of the color, and wherein developing the base color toner image comprises developing the color separation with the color developer unit using the base developer voltage and developing the variant color toner image comprises developing the light color separation with the color developer unit using the variant developer voltage.

12. The method of claim 11, wherein the variant developer voltage is different to the base developer voltage.

13. The method of claim 11, wherein the developer unit develops a toner image having a first thickness when using the base developer voltage and develops a toner image having a different thickness when using the variant developer voltage.

14. The method of claim 11, wherein the base developer voltage is in the region of about −450 to −500V and wherein the variant developer voltage is in the region of about −250 to −300V.

15. The method of claim 11, wherein generating the latent electrostatic image corresponding to the second color separation comprises generating the latent electrostatic image using a larger spot size than when generating the latent electrostatic image corresponding to the first color separation.

16. A liquid electro-photographic printer comprising:

a photoconductor member;

an imaging unit to generate a latent electrostatic image on the photoconductor member;

a developer unit to develop a toner image on the photoconductor in accordance with the latent electrostatic image; and a controller to:

obtain image data representing a base color color separation and a variant color color separation;

control the imaging unit to generate a base color latent electrostatic image on the photoconductor member corresponding to the base color color separation;

control the developer unit to develop a base color toner image on the photoconductor member in accordance with the base color latent electrostatic image using a base developer voltage;

control the imaging unit to generate a variant color latent electrostatic image on the photoconductor member corresponding to the variant color color separation; and control the developer unit to develop a variant color toner image on the photoconductor member in accordance with the variant color latent electrostatic image using a variant developer voltage, wherein the developer unit comprises a color developer unit for a color and wherein the controller is to obtain image data representing a color color separation for the color as the base color color separation and a light color color separation for a light color of the color as the variant color color separation, and to control the color developer unit to develop the color color separation using the base developer voltage and develop the light color color separation using the variant developer voltage.

17. The printer of claim 16, wherein the base developer voltage is in the region of about −450 to −500V and wherein the variant developer voltage is in the region of about −250 to −300V.

18. The printer of claim 16, wherein the controller controls the imaging unit to generate the base color latent electrostatic image using a larger spot size than when generating the variant color latent electrostatic image.

* * * * *